US009081323B2

(12) United States Patent
Maeshima et al.

(10) Patent No.: US 9,081,323 B2
(45) Date of Patent: Jul. 14, 2015

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Hideki Maeshima, Mishima (JP); Kuniaki Hirukawa, Susono (JP); Yu Fukasawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/906,678

(22) Filed: May 31, 2013

(65) Prior Publication Data

US 2013/0322920 A1 Dec. 5, 2013

(30) Foreign Application Priority Data

Jun. 4, 2012 (JP) ..... 2012-127136

(51) Int. Cl.
*G03G 21/16* (2006.01)
*G03G 15/08* (2006.01)

(52) U.S. Cl.
CPC ..... *G03G 15/0808* (2013.01); *G03G 15/0894* (2013.01); *G03G 2215/0132* (2013.01); *Y10T 29/49547* (2015.01)

(58) Field of Classification Search
CPC ..... G03G 21/1853; G03G 21/1647; G03G 21/1676
USPC ..... 399/111
See application file for complete search history.

(56) References Cited

U.S. PATENT DOCUMENTS

| | | | | |
|---|---|---|---|---|
| 6,070,027 | A * | 5/2000 | Kawai et al. | 399/103 |
| 7,190,921 | B2 * | 3/2007 | Ishii et al. | 399/111 |
| 2005/0254862 | A1 * | 11/2005 | Toba et al. | 399/284 |
| 2011/0013929 | A1 * | 1/2011 | Kim et al. | 399/103 |
| 2013/0108918 | A1 * | 5/2013 | Kambayashi | 429/185 |

FOREIGN PATENT DOCUMENTS

JP 2006-208689 A 8/2006

OTHER PUBLICATIONS

Machine translation of Okamoto JP 2006-208689 A, publication date: Aug. 10, 2006.*

* cited by examiner

*Primary Examiner* — Walter L Lindsay, Jr.
*Assistant Examiner* — Frederick Wenderoth
(74) *Attorney, Agent, or Firm* — Canon USA Inc. IP Division

(57) ABSTRACT

A developing device includes a frame configured to store developer, a developing roller arranged at an opening of the frame and configured to bear the developer and to form a developer image on an image bearing member, and a supply roller including a rotational shaft passing through a through-hole provided in the frame and configured to supply the developer to the developing roller, wherein the through-hole is formed so that the supply roller is insertable from an outside of the frame in an axial direction of the supply roller, and has such a size that the supply roller is insertable without rubbing an inner edge of the through-hole.

10 Claims, 14 Drawing Sheets

DEVELOPING DEVICE, PROCESS CARTRIDGE, AND IMAGE FORMING APPARATUS

BACKGROUND OF THE INVENTION

1. Field of the Invention

The present invention relates to an electrophotographic image forming apparatus capable of forming an image on a recording medium by employing electrophotography.

2. Description of the Related Art

Here, the electrophotographic image forming apparatus is an apparatus configured to form an image on a recording medium by employing electrophotography. Examples of the electrophotographic image forming apparatus include an electrophotographic copying machine, an electrophotographic printer (such as a laser beam printer and a light-emitting diode (LED) printer), and a facsimile apparatus. A process cartridge is formed by integrating into a cartridge an electrophotographic photosensitive drum and a process unit acting thereon, and is attachable and detachable to and from the image forming apparatus main body. Examples of the process unit include a charging unit acting on the electrophotographic photosensitive drum, a developing unit, and a cleaning unit.

The developing device as the developing unit included in the process cartridge mainly includes a frame storing developer, a developing roller, a supply roller supplying toner to the developing roller, and a developer regulating member configured to regulate the thickness of the developer (hereinafter, referred to as the "toner") on the developing roller.

Here, Japanese Patent Application Laid-Open No. 2006-208689 discusses a method for mounting a supply roller on a frame in which the supply roller is mounted on the frame in the axial direction of the supply roller. According to Japanese Patent Application Laid-Open No. 2006-208689, a through-hole is formed on a side surface of the frame, and the supply roller is inserted in the axial direction from the through-hole, thereby mounting the supply roller on the frame.

In the configuration discussed in Japanese Patent Application Laid-Open No. 2006-208689, the cross section of a through-hole, through which the supply roller is inserted, is smaller than that of the supply roller, so that, when the supply roller is to be inserted into the through-hole, the peripheral surface of the supply roller is rubbed against the inner edge of the through-hole. As a result, there is a possibility that the peripheral surface of the supply roller is damaged.

SUMMARY OF THE INVENTION

The present invention is directed to a developing device in which a supply roller is inserted into a frame storing developer in the axial direction of the supply roller, in such a manner that the damage of the peripheral surface of the supply roller is suppressed.

According to an aspect of the present invention, a developing device includes a frame configured to store developer, a developing roller arranged at an opening of the frame and configured to bear the developer and to form a developer image on an image bearing member, and a supply roller including a rotational shaft passing through a through-hole provided in the frame and configured to supply the developer to the developing roller, wherein the through-hole is formed so that the supply roller is insertable from an outside of the frame in an axial direction of the supply roller, and has such a size that the supply roller is insertable without rubbing an inner edge of the through-hole.

Further features of the present invention will become apparent from the following description of exemplary embodiments with reference to the attached drawings.

DESCRIPTION OF THE EMBODIMENTS

Figure 1:
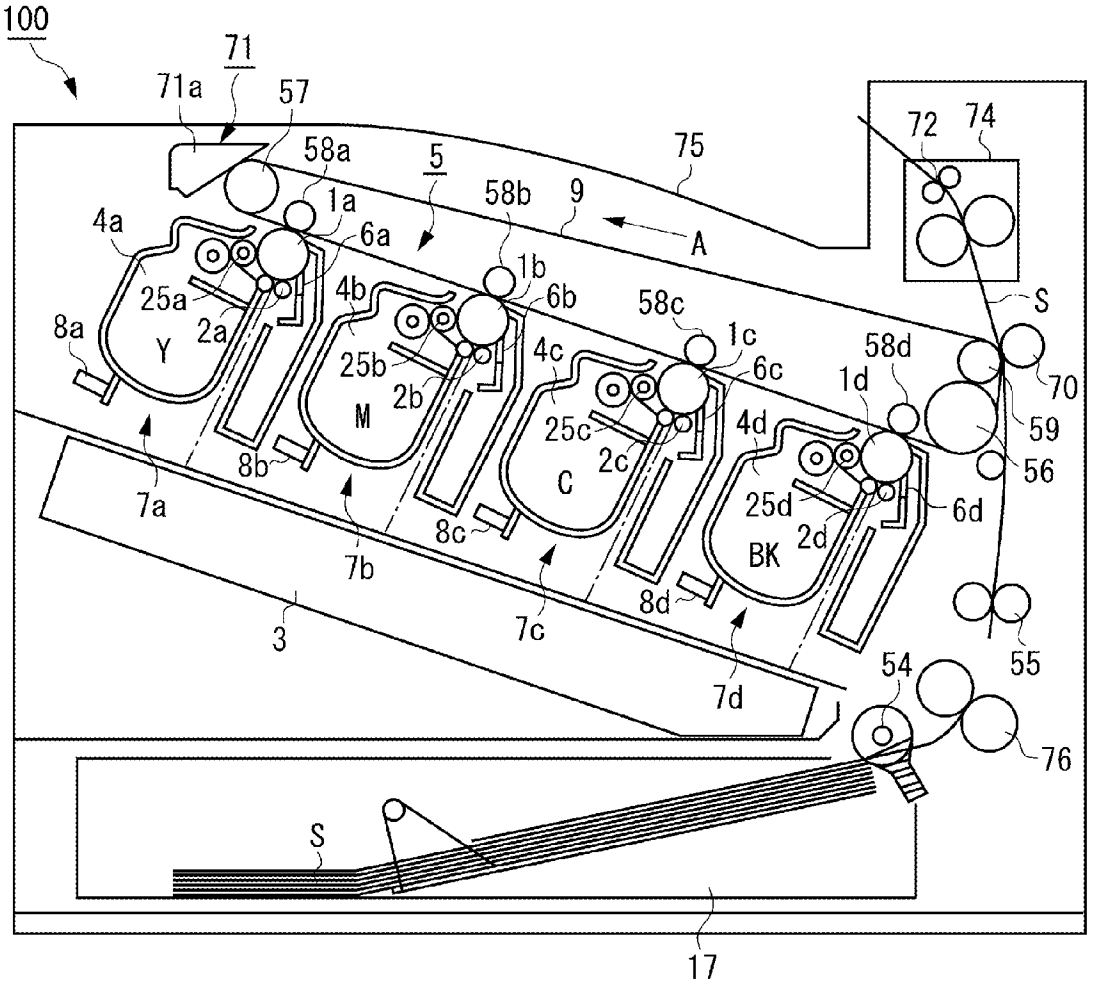
FIG. 1 is a schematic diagram illustrating a configuration of an electrophotographic image forming apparatus according to an exemplary embodiment of the present invention.

A process cartridge and a color electrophotographic image forming apparatus according to an exemplary embodiment of the present invention will be described. FIG. 1 is an overall diagram illustrating the configuration of the color electrophotographic image forming apparatus according to the present exemplary embodiment.

(Overall Configuration of the Image Forming Apparatus)

The overall configuration of the image forming apparatus will be described with reference to FIG. 1. An image forming apparatus 100 illustrated in FIG. 1 includes four process cartridge attachment portions (not illustrated). In FIG. 1, symbols Y, M, C, and BK respectively indicate first through fourth image forming stations configured to form images with yellow, magenta, cyan, and black developer (toner) corresponding to the color components of a full color image. The image forming stations Y, M, C, and BK are arranged inside the apparatus main body 100 to be inclined with respect to the horizontal direction.

Respectively arranged in the image forming stations Y, M, C, and BK to surround the periphery of electrophotographic photosensitive drums 1 (1*a*, 1*b*, 1*c*, and 1*d*) serving as the image bearing members, are electrophotographic process units, such as charging rollers 2 (2*a*, 2*b*, 2*c*, and 2*d*) configured to uniformly charge the surfaces of the photosensitive drums 1, developing rollers 25 (25*a*, 25*b*, 25*c*, and 25*d*) configured to develop latent images formed on the photosensitive drums 1 with toner to visualize the latent images, and cleaning members 6 (6*a*, 6*b*, 6*c*, and 6*d*) configured to remove any toner remaining on the photosensitive drums 1 after transfer of developer images formed on the photosensitive drums 1 to a recording medium. As described below, the photosensitive drums 1, the charging rollers 2, the developing rollers 25, and the cleaning members 6 are integrally formed in process cartridges 7 (7*a*, 7*b*, 7*c*, and 7*d*), which are attachable and detachable to and from the apparatus main body 100.

Further, below the process cartridges inside the image forming apparatus main body, there is provided a scanner unit 3 for forming latent images on the photosensitive drums 1 by performing selective exposure of the photosensitive drums 1 based on image information.

In the lower portion of the apparatus main body, there is attached a cassette 17 storing recording mediums S. A recording medium conveyance unit is provided so that the recording mediums S may pass the positions of the photosensitive drums 1 to be conveyed to the upper portion of the apparatus main body. More specifically, there are provided a feeding roller 54 configured to feed the recording mediums S in the cassette 17 one by one, a conveyance roller pair 76 configured to convey the fed recording mediums S, and a registration roller pair 55 for synchronizing the latent images formed on the photosensitive drums 1 with the recording mediums S. Further, an intermediate transfer unit 5 as an intermediate transfer unit for transferring the toner images formed on the photosensitive drums 1 (1*a*, 1*b*, 1*c*, and 1*d*) is provided above the process cartridges 7 (7*a*, 7*b*, 7*c*, and 7*d*). The intermediate transfer unit 5 includes a driving roller 56, a driven roller 57, primary transfer rollers 58 (58*a*, 58*b*, 58*c*, and 58*d*) situated opposite the respective photosensitive drums of the different colors, and a counter roller 59 situated opposite a secondary transfer roller 70, with a transfer belt 9 being wrapped around the rollers. The transfer belt 9 is located opposite all the photosensitive drums 1 and is configured to circulate to contact therewith. By applying a voltage to the primary transfer rollers 58 (58*a*, 58*b*, 58*c*, and 58*d*), primary transfer is performed from the photosensitive drums 1 to the transfer belt 9. Then, a voltage is applied to the counter roller 59 arranged within the transfer belt 9 and to the secondary roller 70, whereby the toner image on the transfer belt 9 is transferred to the recording medium S.

At the time of image formation, the photosensitive drums 1 are rotated, and selective exposure is performed by the scanner unit 3 on the photosensitive drums 1 uniformly charged by the charging rollers 2. As a result, electrostatic latent images are formed on the photosensitive drums 1. The latent images are developed by the developing rollers 25. As a result, developer images of different colors are formed on the photosensitive drums 1. In synchronization with the image formation, the registration roller pair 55 conveys the recording medium S to a secondary transfer position where the counter roller 59 and the secondary transfer roller 70 contact each other via the transfer belt 9. Then, a transfer bias voltage is applied to the secondary transfer roller 70, whereby the developer images of different colors on the transfer belt are secondarily transferred to the recording medium S. As a result, a color image is formed on the recording medium S. The recording medium S, on which the color image has been thus formed, undergoes heating and pressure by a fixing unit 74, whereby the developer images are fixed. After this, the recording medium S is discharged to a discharge unit 75 by a discharge roller 72. The fixing unit 74 is arranged in the upper portion of the apparatus main body.

(Process Cartridge)

Figure 3:
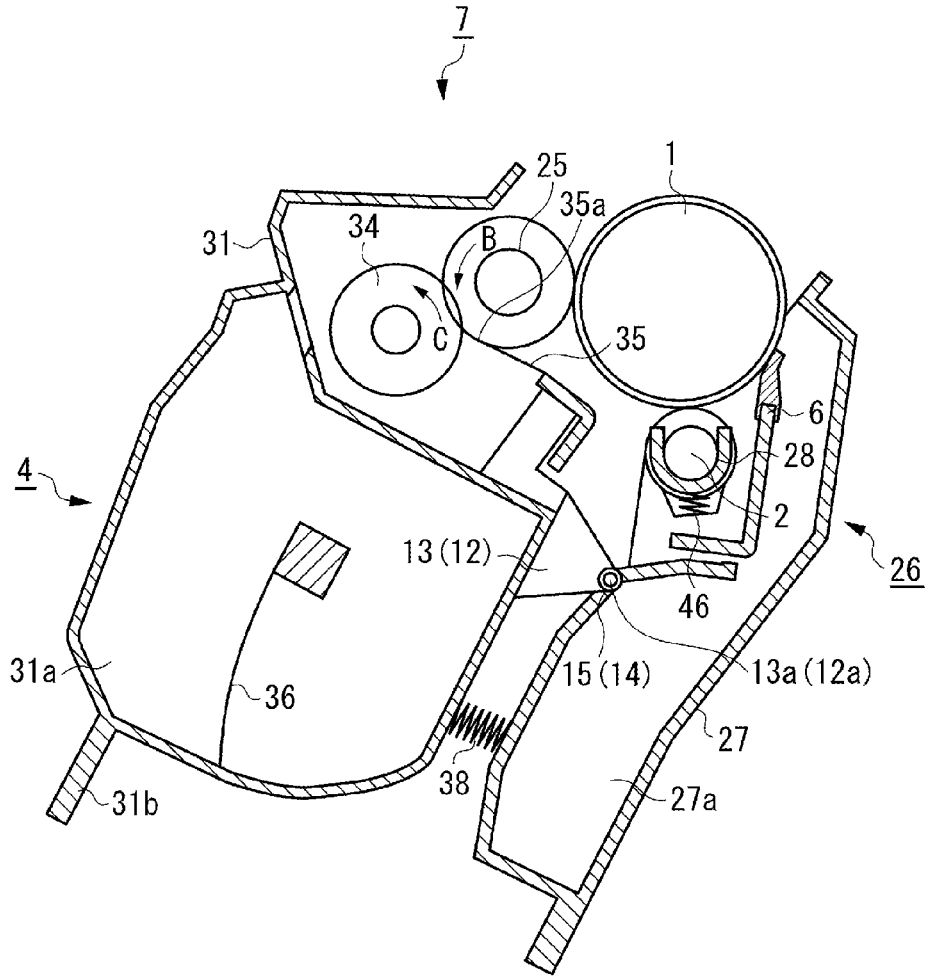
FIG. 3 is a sectional view illustrating a process cartridge according to the exemplary embodiment of the present invention.

Next, the process cartridge according to the exemplary embodiment of the present invention will be described. FIG. 3 is a main sectional view illustrating the process cartridge 7 storing developer (hereinafter, referred to as "toner"). The cartridge 7*a* storing yellow toner, the cartridge 7*b* storing magenta toner, the cartridge 7*c* storing cyan toner, and the cartridge 7*d* storing black toner are of the same configuration.

The process cartridge 7 (7*a*, 7*b*, 7*c*, 7*d*) includes the photosensitive drum 1 (1*a*, 1*b*, 1*c*, 1*d*), the charging roller 2 (2*a*, 2*b*, 2*c*, 2*d*), a cleaning unit 26 (26*a*, 26*b*, 26*c*, 26*d*) equipped with a cleaning member 6 (6*a*, 6*b*, 6*c*, 6*d*), and the developing unit 4 (4*a*, 4*b*, 4*c*, 4*d*) serving as the developing device including a developing roller.

Figure 4:
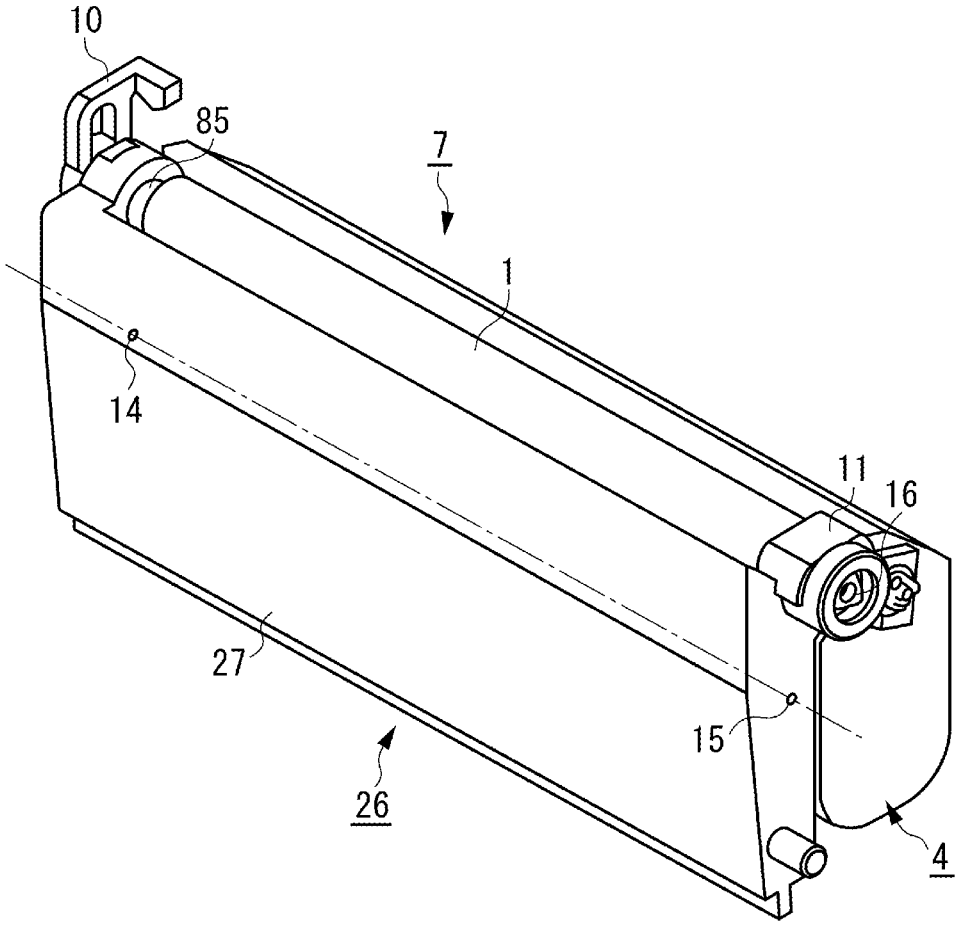
FIG. 4 is an outward perspective view illustrating the process cartridge according to the exemplary embodiment of the present invention.

The photosensitive drum 1 is rotatably mounted on the cleaning frame 27 of the cleaning unit 26 via a front drum bearing 10 and a rear drum bearing 11 (refer to FIG. 4). As described above, the charging roller 2 and the cleaning member 6 are arranged in the periphery of the photosensitive drum 1.

Further, residual toner removed from the surface of the photosensitive drum 1 by the cleaning member 6 falls into a removal toner chamber 27*a*. By transmitting the drive force of a main body drive motor (not illustrated) to the cleaning unit 26, the photosensitive drum 1 is rotated according to the image forming operation. The charging roller 2 is rotatably mounted on the cleaning frame 27 via a charging roller bearing 28, and is pressed toward the photosensitive drum 1 by a charging roller pressing member 46 to be driven to rotate with the rotation of the photosensitive drum 1.

The developing unit 4 mainly includes a developing frame 31, a developing roller 25, a toner supply roller 34, a developing blade 35, and a toner conveyance member 36. The developing frame 31 stores developer. The developing roller 25 is rotatably supported by the developing frame 31 via a front developing bearing 12 and a rear developing bearing 13 (refer to FIG. 5) respectively provided both sides of the developing frame body, and is arranged at an opening 31*s* of the developing frame 31. The developing roller 25 bears toner on the peripheral surface thereof, and rotates in the direction of the arrow B in FIG. 3 while contacting the photosensitive drum 1. Thus, the developing roller 25 develops the electrostatic latent image formed on the photosensitive drum 1 to form the developer image. The toner supply roller 34 includes on its surface an urethane foam layer as a foam layer, and includes a supply roller shaft 34*h* as a rotational shaft member. The toner supply roller 34 rotates in the direction of the arrow C in FIG. 3 while contacting the developing roller 25, and supplies toner to the developing roller 25. The developing blade 35 regulates toner layers on the toner supply roller 34 and the developing roller 25. The toner conveyance member 36 is provided in a toner storing portion 31*a* of the developing frame 31. The toner conveyance member 36 stirs the stored toner, and conveys the toner to the toner supply roller 34.

FIG. 4 is an external perspective view illustrating the process cartridge. The developing unit 4 is rotatably mounted on the cleaning unit 26. A front support pin 14 and a rear support pin 15, which are formed on the cleaning frame 27, engage with suspension holes 12*a* and 13*a* (refer to FIG. 5) of the front developing bearing 12 and the rear developing bearing 13, respectively, so that the developing unit 4 is rotatably supported with respect to the cleaning frame 27 (refer to FIGS. 3 and 4). Further, the cleaning frame 27 includes a front drum bearing 10 and a rear drum bearing 11 rotatably supporting the photosensitive drum 1. The rear drum bearing 11 supports a drum coupling 16 coupled with the photosensitive drum 1 to transmit the drive force of the image forming apparatus main body to the electrophotographic photosensitive drum.

Figure 5:
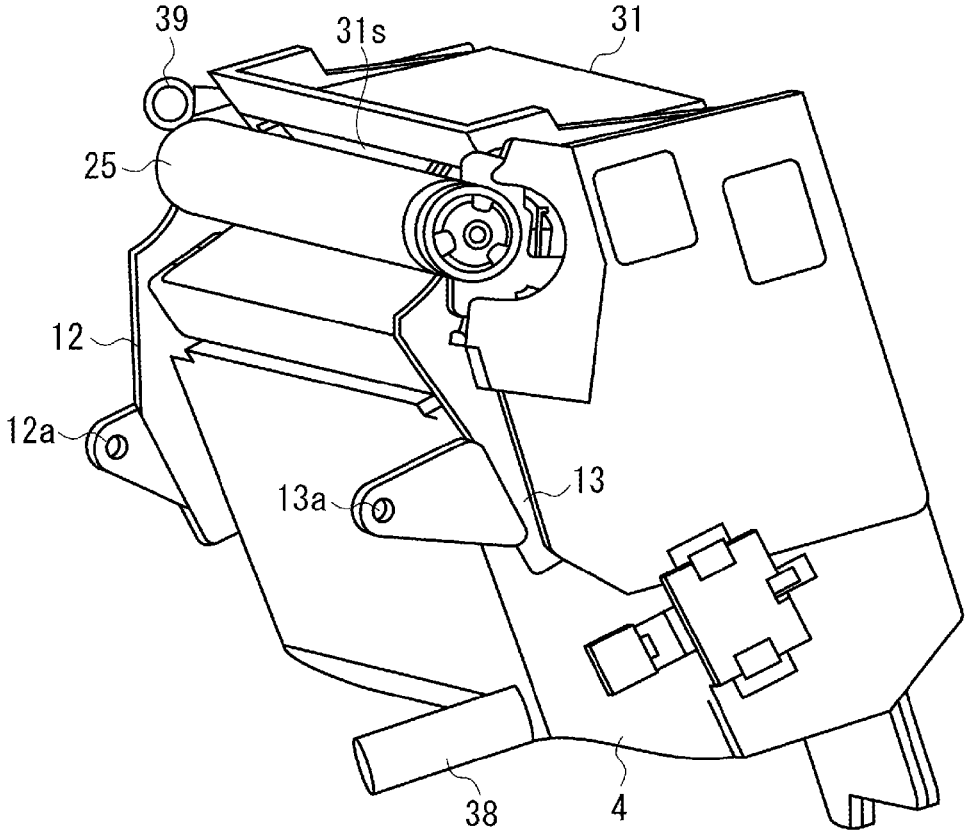
FIG. 5 is a perspective view illustrating a developing unit according to the exemplary embodiment of the present invention.

Further, at the time of image formation by the process cartridge 7, the developing unit 4 illustrated in FIG. 5 is urged toward the cleaning unit 26 by a pressure spring 38 provided on the developing frame 31 and a tension spring 39 provided on the front developing bearing 12. The holes 12*a* and 13*a* of the front developing bearing 12 and the rear developing bearing 13 constitute rotational centers, so that the springs provides a pressing force for the developing roller 25 contacting the photosensitive drum 1.

In the contact developing system, in which development is performed with the photosensitive drum 1 and the developing roller 25 contacting each other, it is desirable to form the photosensitive drum 1 as a rigid body and to form the developing roller 25 as a roller including an elastic member. This elastic member includes, for example, a single layer of solid rubber or the one formed by coating a solid rubber layer with resin in consideration of a charge imparting property for the toner.

Next, a series of operation related to the image formation by the process cartridge will be described (refer to FIGS. 1 and 3). When image information is transmitted to the image forming apparatus, a main body driving motor (not illustrated) starts to rotate, and transmits drive to the photosensitive drum 1. Then, a charging bias voltage is applied to the charging roller 2 by the image forming apparatus main body, uniformly charging the surface of the photosensitive drum 1. According to the image information, exposure is performed by the scanner 3 to form a latent image on the photosensitive drum 1.

The toner in the developing frame 31 is sent into a toner supply roller 34 by a developer conveyance mechanism 36. Then, the toner supply roller 34 supplies the toner to the outer periphery of the developing roller 25. The supplied toner is friction-charged on the outer periphery of the developing roller 25 by the developing blade 35. Then, a developing bias voltage is applied to the developing roller 25 from the apparatus main body. As a result, the electrostatic latent image formed on the electrophotographic photosensitive drum 1 is developed. The developing roller 25 is arranged opposite the photosensitive drum 1. The developing roller 25 contacts the photosensitive drum 1, and develops the electrostatic latent image formed on the photosensitive drum 1.

(Configuration of the Developing Unit)

Figure 2:
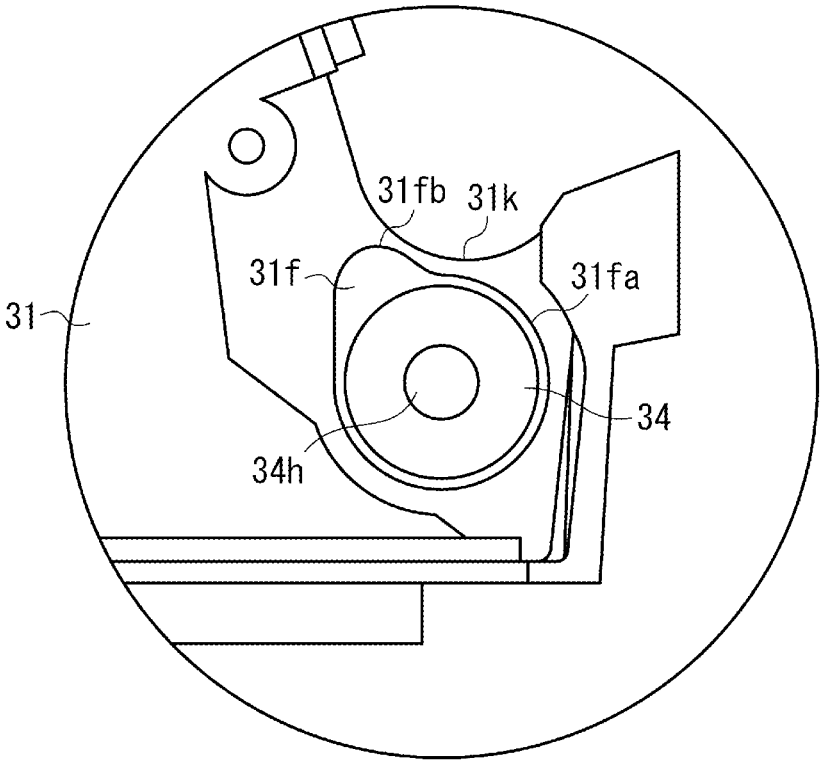
FIG. 2 is a diagram illustrating the exemplary embodiment of the present invention in detail.
Figure 6:
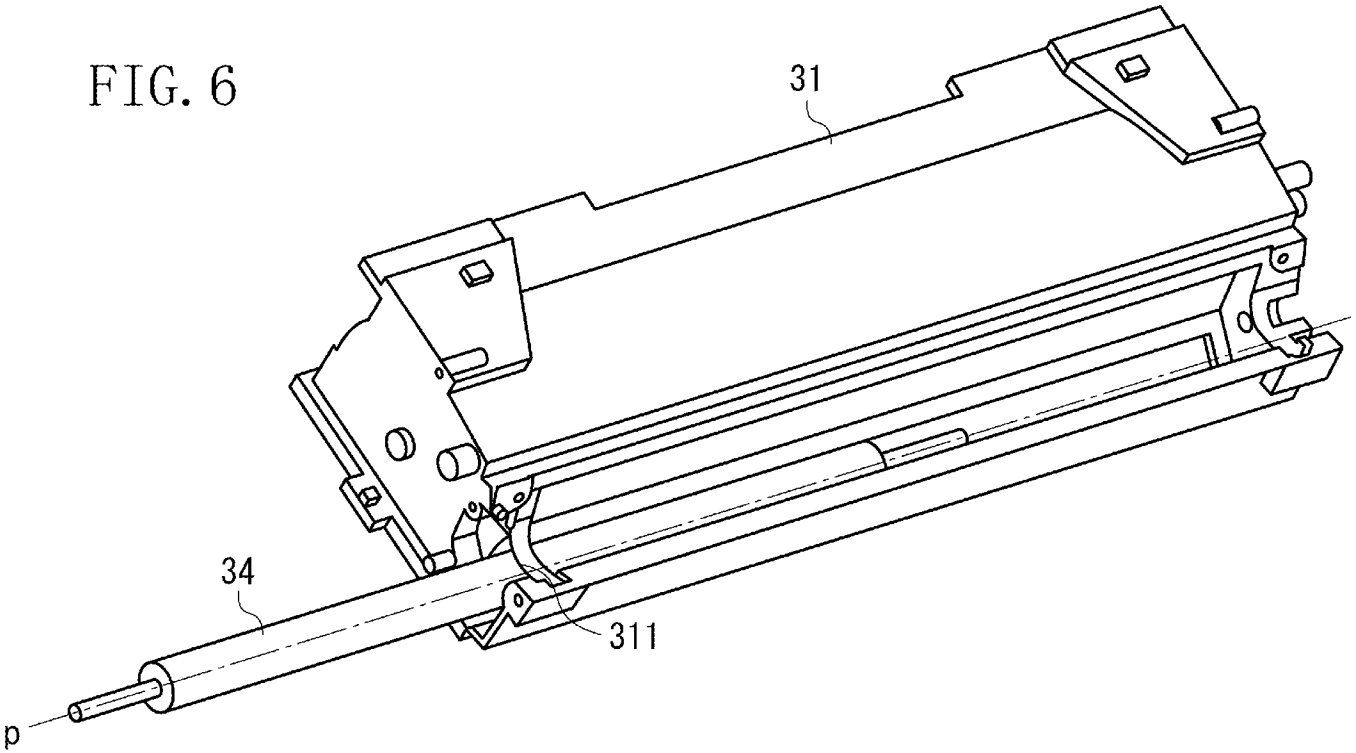
FIG. 6 is a perspective view illustrating an assembly process of a developing device according to the present exemplary embodiment.
Figure 11:
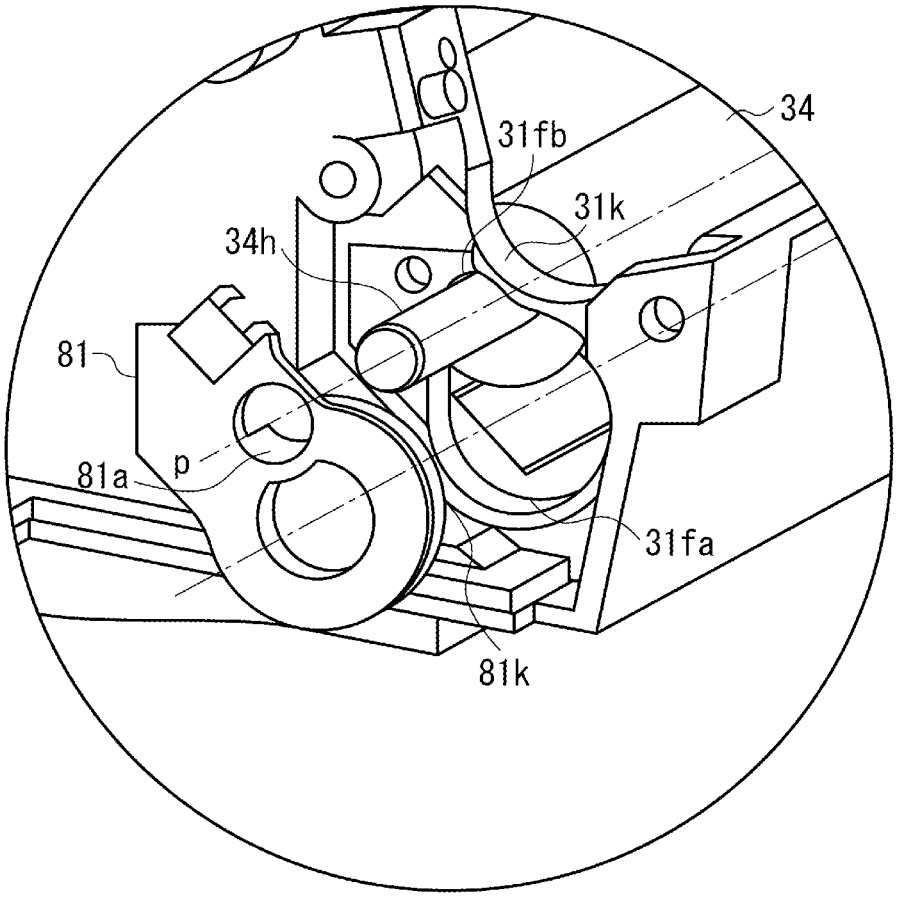
FIG. 11 is a perspective view illustrating the assembly process of the developing device according to the present exemplary embodiment.

The developing unit 4 according to the present exemplary embodiment will be described in detail. As illustrated in FIGS. 6 and 11, the developing frame 31 includes at one end side surface a through-hole 31*f*, which is formed so that the supply roller 34 is insertable from the outside of the developing frame 31 in the direction of the axis p of the supply roller. Further, as illustrated in FIG. 2, the through-hole 31*f* includes an insertion hole 31*fa* (an insertion portion) for inserting the supply roller 34 and a first guide hole 31*fb* (a guide portion) configured to guide a supply roller shaft 34*h*. As illustrated in FIG. 2, the insertion hole 31*fa* is formed to be larger than the cross section of the supply roller (that is, the cross section of the through-hole perpendicular to the axis p is larger than the cross section of the supply roller perpendicular to the axis p), thereby facilitating the insertion of the supply roller 34. As a result, when inserting the supply roller 34 into the insertion hole 31*fa*, it is possible to suppress the rubbing of the supply roller 34 against the inner edge of the insertion hole 31. Thus, it is possible to suppress damage of the supply roller 34.

Figure 7:
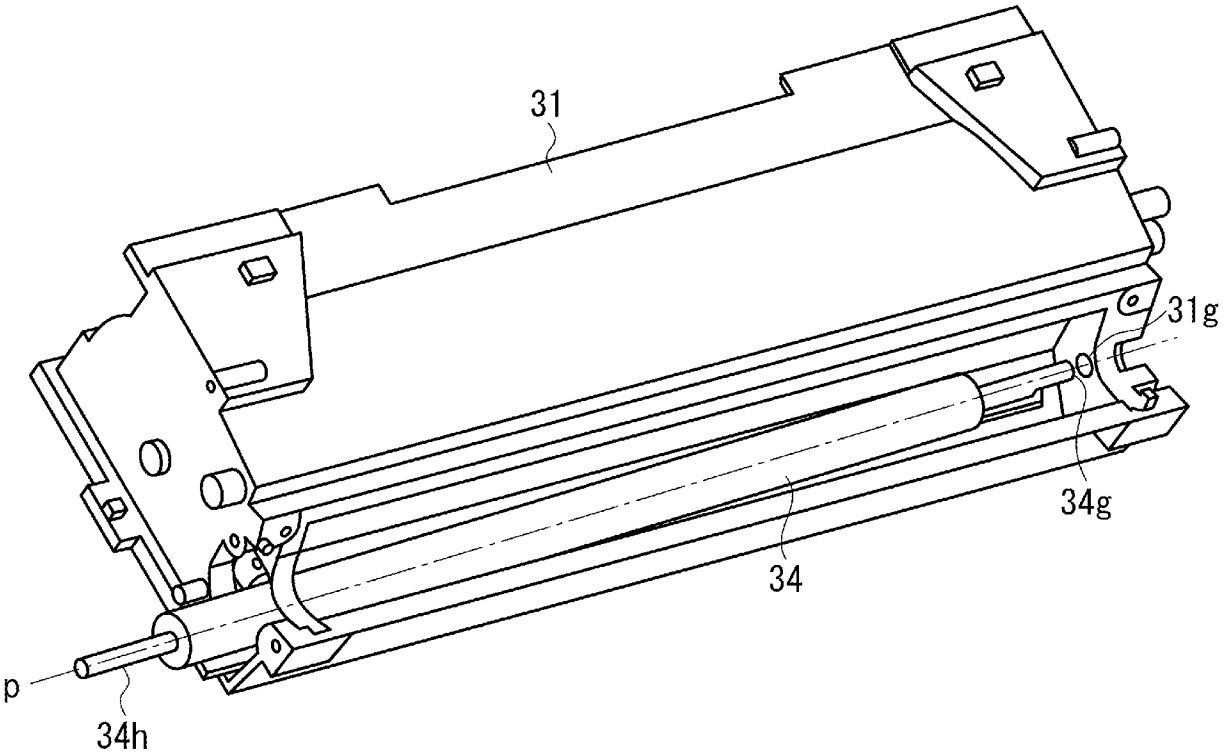
FIG. 7 is a perspective view illustrating the assembly process of the developing device according to the present exemplary embodiment.

In the process in which the supply roller 34 is inserted into the developing frame 31, a supply roller shaft 34*g* is inserted into a second guide hole 31*g* provided at the other longitudinal end side of the developing frame 31 (refer to FIG. 7).

Figure 8:
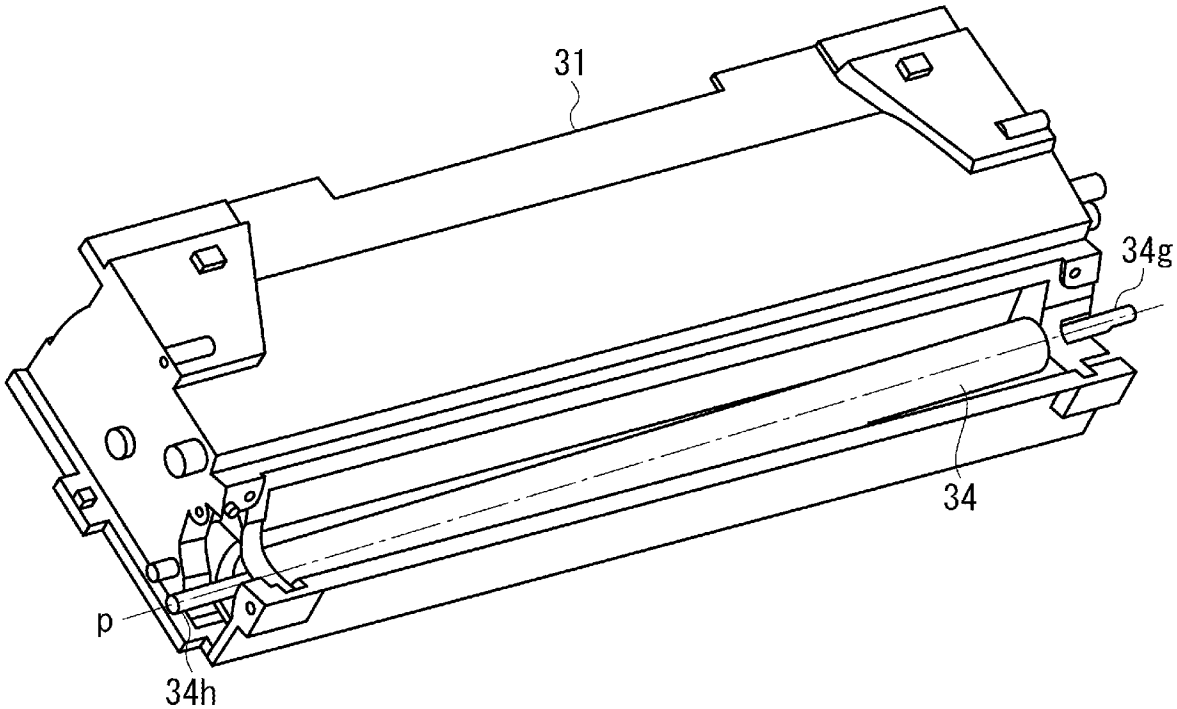
FIG. 8 is a perspective view illustrating the assembly process of the developing device according to the present exemplary embodiment.
Figure 9:
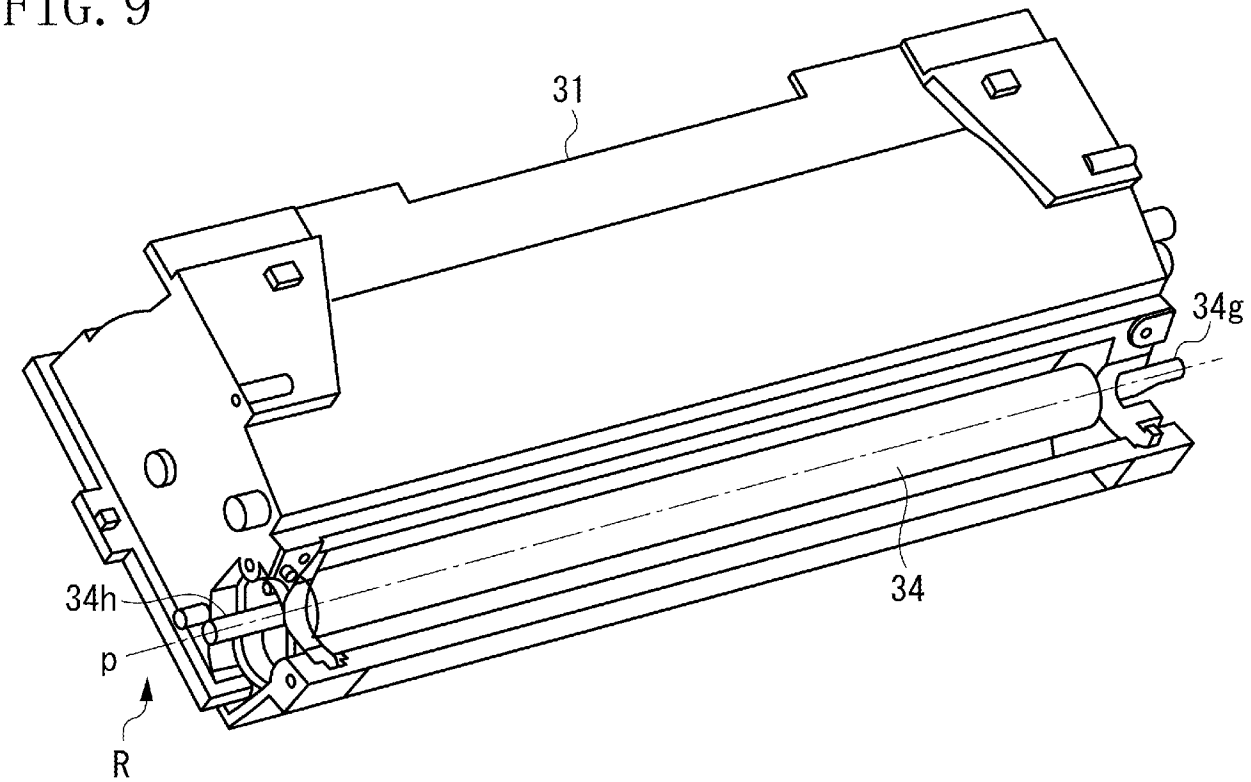
FIG. 9 is a perspective view illustrating an assembly process of the developing device according to the present exemplary embodiment.

The insertion hole 31*fa* and the first guide hole 31*fb* provided at one end of the developing frame 31 are connected together to allow movement of the supply roller 34. As illustrated in FIGS. 8 and 9, after the insertion of the supply roller in the axial direction, the supply roller shaft 34*h* is moved from an insertion hole position (refer to FIG. 8) to a first guide hole position (in the direction R in FIG. 9), and is held there.

Figure 10:
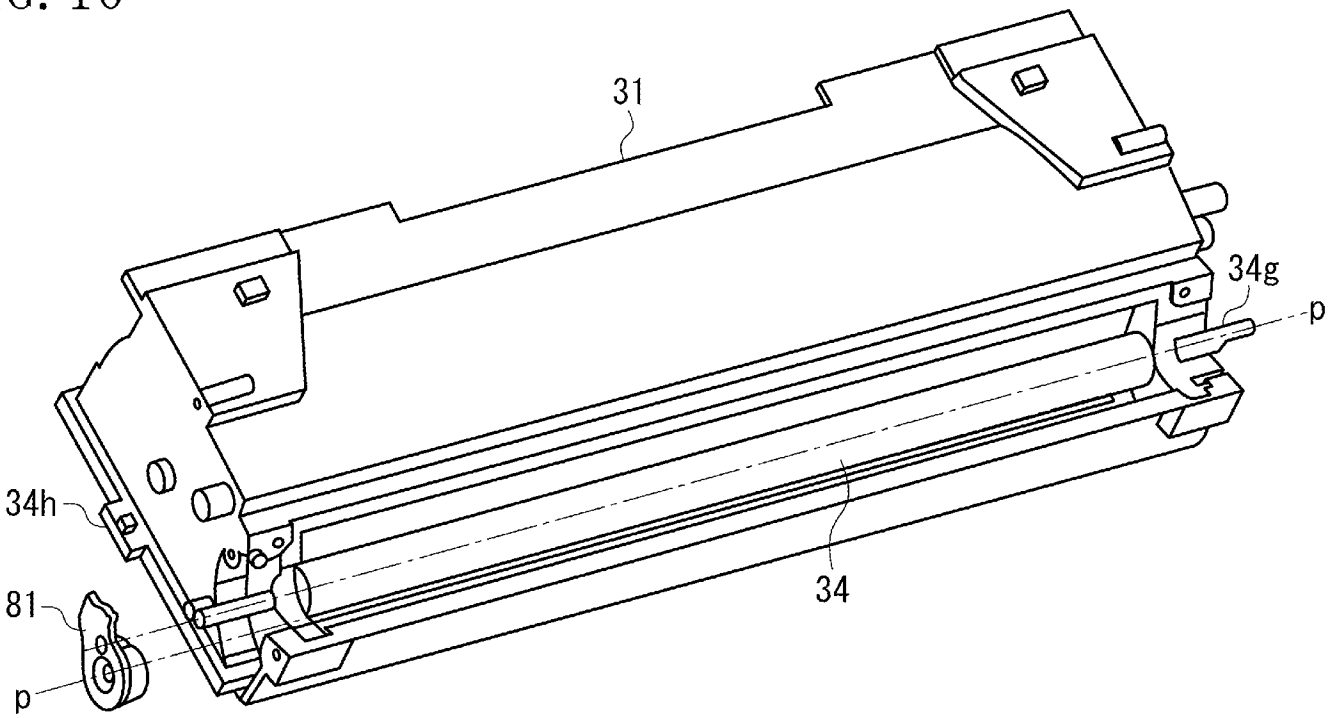
FIG. 10 is a detailed perspective view illustrating the assembly process of the developing device according to the present exemplary embodiment.
Figure 12:
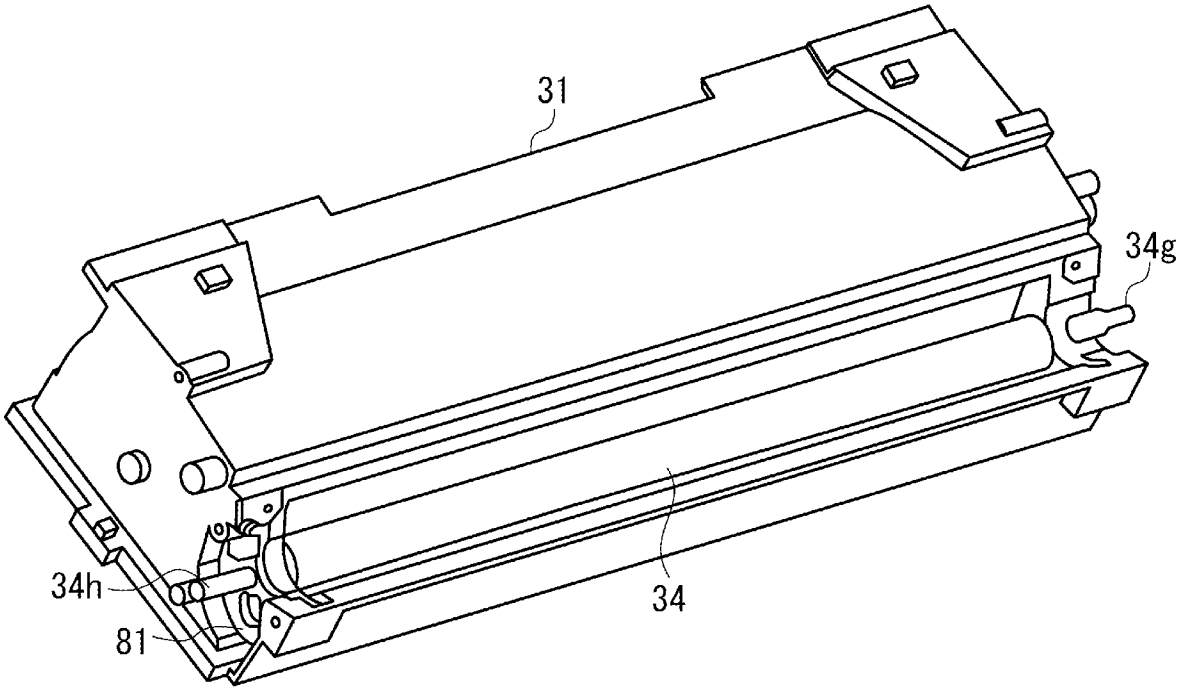
FIG. 12 is a perspective view illustrating the assembly process of the developing device according to the present exemplary embodiment.

After this, a bush member 81 is mounted as illustrated in FIGS. 10, 11, and 12, so that the supply roller shaft 34*h* is guided by a third guide hole 81*a* provided in the bush member 81 at the first guide hole 31*fb* provided in the developing frame 31, and is held there.

Figure 13:
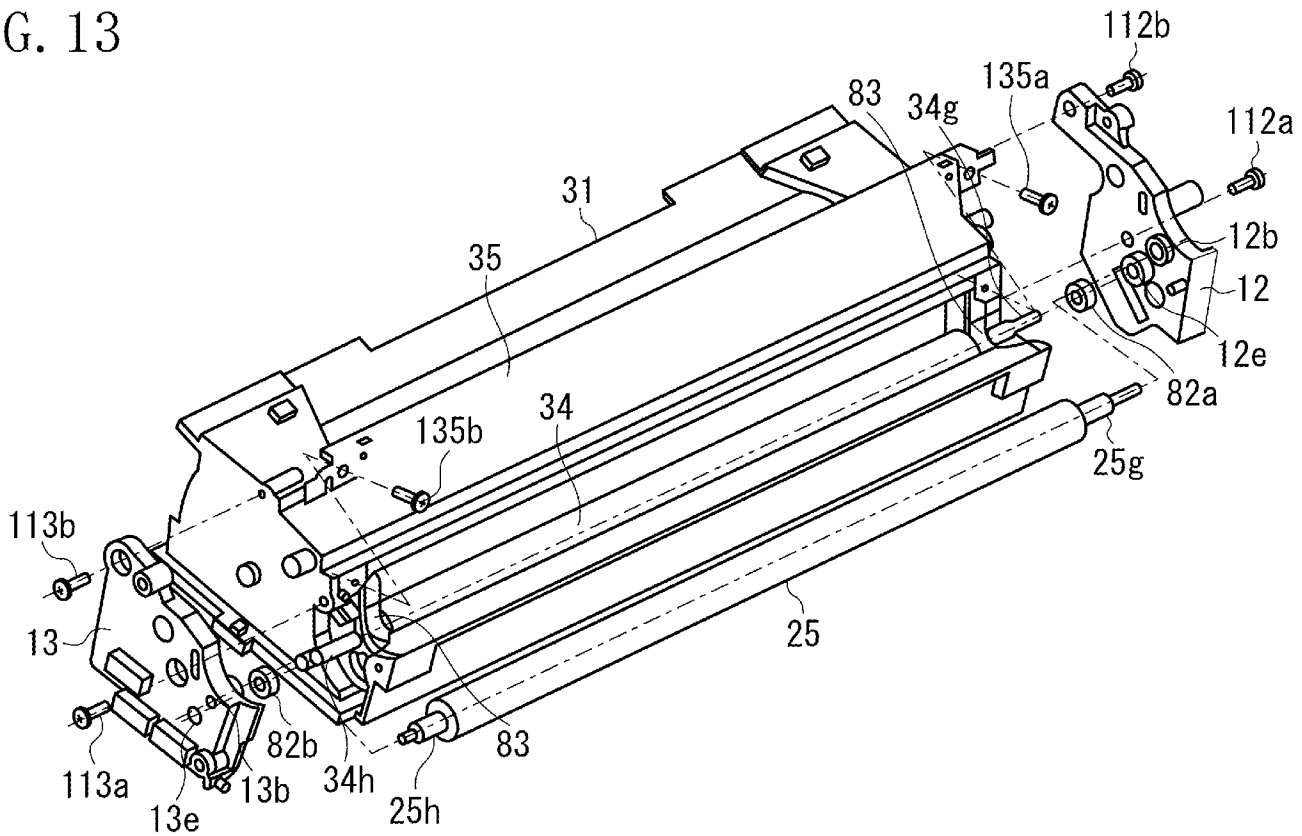
FIG. 13 is a perspective view illustrating an assembly process of the developing device according to the present exemplary embodiment.

Further, as illustrated in FIG. 13, cylindrical bush seal members 82 (82*a* and 82*b*) are respectively inserted into both ends of the supply roller shaft, and, further, the bearing members (the front developing bearing 12 and the rear developing bearing 13) are mounted, so that the position of the supply roller 34 in the cross sectional direction is determined.

If, in FIG. 11, an insertion hole of a diameter larger than the supply roller 34 were provided in the shaft at the supply roller position during image formation, it would be impossible to form on the frame 31 an affixing surface 31*k* for an end portion seal member suppressing toner leakage from the developing roller end portion. In contrast, in the present exemplary embodiment, the insertion hole 31*fa* provided in the developing frame 31 to insert the supply roller 34 is arranged at a position deviating from the first guide hole corresponding to the supply roller position at the time of development. In other words, the through-hole is formed such that the position where the axis p of the supply roller 34 and the through-hole 31*f* cross each other at the time of insertion of the supply roller 34 is farther from the developing roller 25 than the position where the axis p of the supply roller 34 and the through-hole 31*f* cross each other at the time of development (i.e., in a cross section perpendicular to the axial direction of the supply roller, the center of the insertion hole 31*fa* is situated farther from the developing roller than the center of the first guide hole 31*fb*). Accordingly, it is possible to form the through-hole 31*f* larger than the outer diameter of the supply roller 34 while forming the affixing surface 31*k* for the end portion seal on the frame 31.

Further, as illustrated in FIG. 11, as a guide for the supply roller shaft 34*h*, there is formed a guide hole by the first guide hole 31*fb* of the developing frame 31 and the third guide hole 81*a* provided in the bush member 81, so that it is possible to hold the supply roller 34 without the supply roller 34 contacting the developing frame 31 until the developing bearing members (12 and 13) are mounted.

(Developing Unit Assembly Method)

Next, a method for assembling (manufacturing) the developing unit 4 according to the present exemplary embodiment will be described.

As illustrated in FIG. 6, the supply roller 34 is inserted into the insertion hole 31*f* from the outside of the developing frame 31 in the direction of the supply roller axis p. As illustrated in FIG. 2, the insertion hole 31*fa* is formed to be larger than the maximum outer diameter of the supply roller, thereby facilitating the insertion of the supply roller 34. As a result, when inserting the supply roller 34 into the insertion hole 31*fa*, it is possible to suppress the rubbing of the supply roller 34 against the developing frame 31. Thus, it is possible to suppress damage of the supply roller 34. In the process of insertion, the supply roller shaft 34*g* is inserted into the second guide hole 31*g* with the supply roller 34 being inclined such that the supply roller shaft 34*g* is aligned with the second guide hole 31*g* provided on the other end side surface of the developing frame 31 (refer to FIG. 7).

Next, as illustrated in FIGS. 8 and 9, in the state in which the supply roller shaft 34*g* is held by the second guide hole 31*g*, the supply roller shaft 34*h* at the one end side portion is moved from the insertion hole 31*fa* to the first guide hole 31*fb* (The supply roller is moved toward the position to supply toner to the developing roller). In the state in which the supply roller shaft 34*h* is held by the first guide hole 31*fb*, the bush member 81 is mounted. The bush member 81 serves to prevent outflow of the toner in the developing chamber due to fit-engagement with the insertion hole 31*fa* provided in the developing frame 31. The bush member 81 also serves to support the supply roller 34 until the developing bearing members (12 and 13) are mounted, by guiding the supply roller shaft 34*h* by the first guide hole 31*fb* (refer to FIGS. 10 and 11).

Next, as illustrated in FIG. 13, the cylindrical bush seal members 82 (82*a* and 82*b*) are respectively inserted into both end portions (34*g* and 34*h*) of the supply roller shaft. The bush seal members (82*a* and 82*b*) are respectively compressed in the direction of the supply roller shaft by the developing bearing members (12 and 13), the developing frame 31, and the bush member 81, preventing the outflow of toner through the gap between the guide hole and the supply roller shaft.

Figure 14:
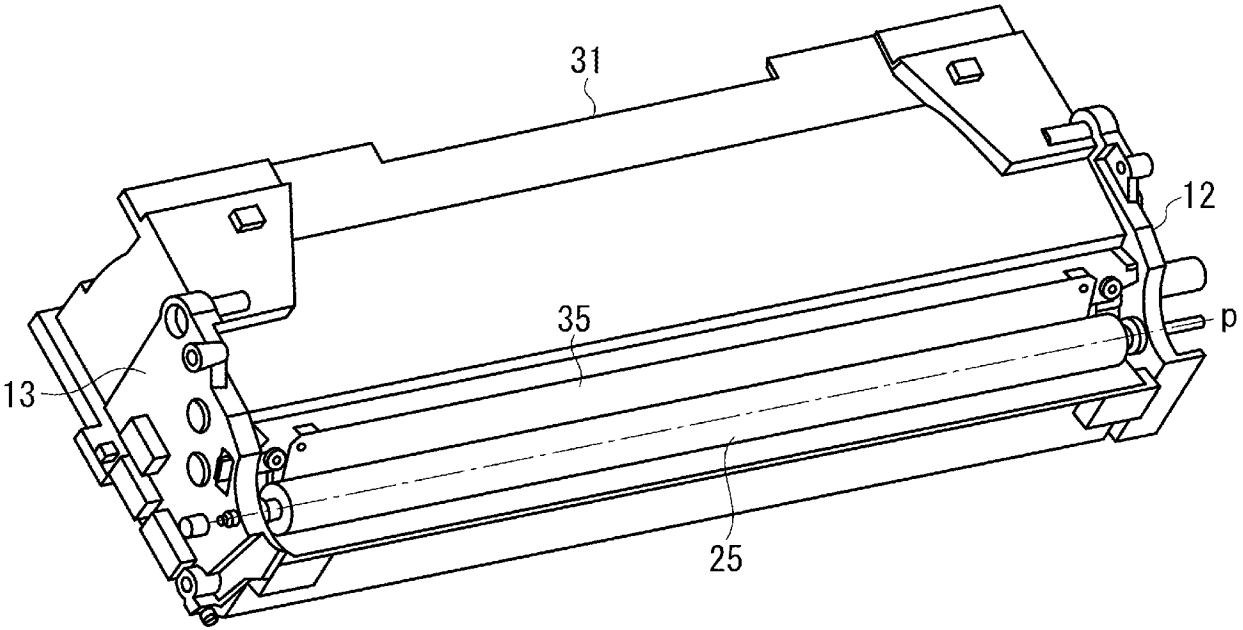
FIG. 14 is a perspective view illustrating the assembly process of the developing device according to the present exemplary embodiment.

Further, the end portion seal member 83 is affixed to the affixing surface 31*k* of the developing frame 31, and a regulation member 35 is mounted on the developing frame 31 by fastening members (135*a* and 135*b*) (refer to FIG. 13). Further, as illustrated in FIGS. 13 and 14, the developing bearing members (12 and 13) are mounted. The developing bearing members rotatably support the developing roller 25 and the supply roller 34, respectively. As a supporting method, the developing shafts 25*g* and 25*h* at the developing roller end portions are respectively inserted into the bearing holes 12*b* and 13*b* provided in the developing bearing members to support the developing roller 25. Further, by inserting the supply roller shafts (34*g* and 34*h*) into the bearing holes (12*e* and 13*e*) of the developing bearing members, it is possible to support the supply roller 34. After the mounting of the developing bearing members (12 and 13), the developing bearing members (12 and 13) are mounted on the developing frame 31 by fastening members (112*a*, 112*b*, 113*a*, and 113*b*) to fix the developing bearing members (12 and 13) in position.

By thus assembling the developing unit, it is possible to suppress the rubbing between the supply roller 34 and the inner edge of the insertion hole 31. Thus, it is possible to suppress damage of the supply roller 34.

According to the exemplary embodiment of the present invention, in a configuration in which the supply roller is inserted into the frame storing developer in the axial direction, it is possible to suppress damage of the peripheral surface of the supply roller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-127136 filed Jun. 4, 2012, which is hereby incorporated by reference herein in its entirety.

What is claimed is:

1. A developing device comprising:

a frame configured to store developer;

a developing roller arranged at an opening of the frame and configured to bear the developer and to form a developer image on an image bearing member; and a supply roller including a rotational shaft passing through a through-hole provided in the frame and configured to supply the developer to the developing roller, wherein the through-hole is formed so that the supply roller is insertable from an outside of the frame in an axial direction of the supply roller, and has such a size that the supply roller is insertable without rubbing an inner edge of the through-hole.

2. A developing device comprising:

a frame configured to store developer;

a developing roller arranged at an opening of the frame and configured to bear the developer and to form a developer image on an image bearing member; and a supply roller including a rotational shaft passing through a through-hole provided in the frame and configured to supply the developer to the developing roller, wherein the through-hole is formed so that the supply roller is insertable from an outside of the frame in an axial direction of the supply roller, and wherein a section of the through-hole perpendicular to the axial direction is larger than a section of the supply roller perpendicular to the axial direction.

3. The developing device according to claim 1, wherein the through-hole is formed such that a position where an axis of the supply roller crosses the through-hole during insertion of the supply roller is farther from the developing roller than a position where the axis crosses the through-hole during development.

4. The developing device according to claim 1, wherein the through-hole includes an insertion portion for inserting therein into the supply roller, and a guide portion for guiding the supply roller to a position for supplying the developer to the developing roller, and wherein, in sections perpendicular to the axial direction, a center of the insertion portion is at a position farther from the developing roller than a center of the guide portion.

5. A process cartridge comprising:

the developing device according to claim 1; and the image bearing member, wherein the process cartridge is attachable and detachable to and from an image forming apparatus main body.

6. An image forming apparatus configured to form an image on a recording medium, the image forming apparatus comprising:

the developing device according to claim 1;

the image bearing member; and a conveyance unit configured to convey the recording medium.

7. A method for manufacturing a developing device, the developing device including:

a frame configured to store developer;

a developing roller arranged at an opening of the frame and configured to bear the developer and to form a developer image on an image bearing member; and a supply roller including a rotational shaft passing through a through-hole provided in the frame and configured to supply the developer to the developing roller, wherein the frame includes a through-hole having such a size that the supply roller is insertable without rubbing an inner edge of the through-hole, the method comprising:

inserting the supply roller into the through-hole from an outside of the frame in an axial direction of the supply roller.

8. The method according to claim 7, further comprising moving the supply roller to a position for supplying the developer to the developing roller after the insertion.

9. A method for manufacturing a developing device, the developing device including:

a frame configured to store developer;

a developing roller arranged at an opening of the frame and configured to bear the developer and to form a developer image on an image bearing member; and a supply roller including a rotational shaft passing through a through-hole provided in the frame and configured to supply the developer to the developing roller, wherein the frame includes the through-hole whose section perpendicular to an axis of the supply roller is larger than a section of the supply roller perpendicular to the axis, the method comprising:

inserting the supply roller into the through-hole from an outside of the frame in an axial direction of the supply roller.

10. The method according to claim 9, further comprising moving the supply roller to a position for supplying the developer to the developing roller after the insertion.

* * * * *